US007090461B2

(12) United States Patent
Liang

(10) Patent No.: US 7,090,461 B2
(45) Date of Patent: Aug. 15, 2006

(54) GAS TURBINE VANE WITH INTEGRAL COOLING FLOW CONTROL SYSTEM

(75) Inventor: George Liang, Palm City, FL (US)

(73) Assignee: Siemens Westinghouse Power Corporation, Orlando, FL (US)

( * ) Notice: Subject to any disclaimer, the term of this patent is extended or adjusted under 35 U.S.C. 154(b) by 101 days.

(21) Appl. No.: 10/697,370

(22) Filed: Oct. 30, 2003

(65) Prior Publication Data

US 2005/0095118 A1 May 5, 2005

(51) Int. Cl.
*F01D 9/06* (2006.01)

(52) U.S. Cl. ..... 415/115

(58) Field of Classification Search ..... 415/115, 415/116, 96 R, 96 A, 97 R
See application file for complete search history.

(56) References Cited

U.S. PATENT DOCUMENTS 3,528,751 A * 9/1970 Quinones et al. ..... 415/115
3,533,711 A * 10/1970 Kercher ..... 416/97 R
3,706,508 A 12/1972 Moskowitz et al.
3,799,696 A * 3/1974 Redman ..... 416/97 R
3,801,218 A 4/1974 Moore
3,930,748 A * 1/1976 Redman et al. ..... 416/97 R
4,236,870 A 12/1980 Hucul, Jr. et al.
4,767,261 A 8/1988 Godfrey et al.
5,120,192 A * 6/1992 Ohtomo et al. ..... 415/115
5,281,097 A 1/1994 Wilson et al.
5,375,973 A 12/1994 Sloop et al.
5,403,156 A 4/1995 Arness et al.
5,511,309 A * 4/1996 Beabout ..... 29/889.72
5,645,397 A 7/1997 Soechting et al.
5,674,050 A 10/1997 Hall et al.
5,690,473 A 11/1997 Kercher
5,741,117 A * 4/1998 Clevenger et al. ..... 415/115
5,902,093 A 5/1999 Liotta et al.
6,318,960 B1 * 11/2001 Kuwabara et al. ..... 415/115
6,491,496 B1 12/2002 Starkweather
6,499,950 B1 12/2002 Willett et al.
2004/0022630 A1 * 2/2004 Tiemann ..... 416/97 R

* cited by examiner

*Primary Examiner*—Christopher Verdier

(57) ABSTRACT

A turbine vane usable in a turbine engine and having at least one cooling system. The cooling system includes a leading edge cavity and a trailing edge cavity. The cavities may be separated with a metering rib having one or more metering orifices for regulating flow of cooling fluids to a manifold cooling system and to trailing edge exhaust orifices. In at least one embodiment, the trailing edge cavity may be a serpentine cooling pathway and the leading edge cavity may include a plurality of leading edge cooling paths.

20 Claims, 3 Drawing Sheets

GAS TURBINE VANE WITH INTEGRAL COOLING FLOW CONTROL SYSTEM

FIELD OF THE INVENTION

This invention is directed generally to turbine vanes, and more particularly to hollow turbine vanes having cooling channels for passing fluids, such as air, to cool the vanes and supply air to the manifold of a turbine assembly.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine vane and blade assemblies to these high temperatures. As a result, turbine vanes and blades must be made of materials capable of withstanding such high temperatures. In addition, turbine vanes and blades often contain cooling systems for prolonging the life of the vanes and blades and reducing the likelihood of failure as a result of excessive temperatures.

Typically, turbine vanes are formed from an elongated portion forming a vane having one end configured to be coupled to a vane carrier and an opposite end configured to be movably coupled to a manifold. The vane is ordinarily composed of a leading edge, a trailing edge, a suction side, and a pressure side. The inner aspects of most turbine vanes typically contain an intricate maze of cooling circuits forming a cooling system. The cooling circuits in the vanes receive air from the compressor of the turbine engine and pass the air through the ends of the vane adapted to be coupled to the vane carrier. The cooling circuits often include multiple flow paths that are designed to maintain all aspects of the turbine vane at a relatively uniform temperature. At least some of the air passing though these cooling circuits is exhausted through orifices in the leading edge, trailing edge, suction side, and pressure side of the vane. A substantial portion of the air is passed into a manifold to which the vane is movably coupled. The air supplied to the manifold may be used, among other uses, to cool turbine blade assemblies coupled to the manifold. While advances have been made in the cooling systems in turbine vanes, a need still exists for a turbine vane having increased cooling efficiency for dissipating heat and passing a sufficient amount of cooling air through the vane and into the manifold.

SUMMARY OF THE INVENTION

This invention relates to a turbine vane having an internal cooling system for removing heat from the cooling vane and for allowing a cooling fluid to pass from a shroud assembly to a manifold assembly. The turbine vane may be formed from a generally elongated hollow vane having a leading edge, a trailing edge, a pressure side, a suction side, a first end adapted to be coupled to a shroud assembly, and a second end opposite the first end and adapted to be coupled to a manifold assembly. The internal cooling system of the turbine vane may include a leading edge cavity and a trailing edge cavity. The trailing edge cavity may be formed from a serpentine cooling path and include one or more exhaust orifices in the trailing edge for exhausting cooling fluids from the serpentine cooling path. The serpentine cooling path may include a first inflow section having one or more inlet orifices at the first end of the turbine vane for receiving cooling fluids from the shroud assembly. The serpentine cooling path may also include a first outflow section in communication with the first inflow section at a first turn. The first outflow section may extend from the first turn generally towards the first end of the turbine vane.

The leading edge cavity may be proximate to the leading edge of the turbine vane and may be formed from a metering rib and inner surfaces of a housing forming the airfoil. The metering rib may define a barrier between the first inflow section of the trailing edge cavity and the leading edge cavity. The metering rib may include one or more metering orifices for regulating fluid flow through the turbine vane. In at least one embodiment, the metering rib may include a plurality of metering orifices positioned along the metering rib. The metering orifices may be sized and positioned to minimize cooling flow separation in the leading edge cavity and to prevent starvation of the trailing edge cooling cavity. The leading edge cavity may also include a plurality of ribs forming a plurality of leading edge cooling paths. The ribs may be positioned to accommodate various heating conditions of the turbine vane and to accommodate downstream cooling requirements. In at least one embodiment, each leading edge cooling path may receive a cooling fluid though a metering orifice in the metering rib. The metering orifices may have equal or different sized cross-sectional areas and may be positioned to maximize the effectiveness of the cooling system.

The turbine vane may receive a cooling fluid from a shroud assembly through an inlet orifice. The cooling fluid may be passed into the first inflow section of the serpentine cooling path and bled off through the metering orifices. A relatively small amount of cooling fluid may continue to pass through the serpentine cooling path and be exhausted through one or more exhaust orifices in the trailing edge. The cooling fluids passing through the metering orifices are passed through the leading edge cavity. In at least one embodiment, the cooling fluids may be separated into numerous leading edge cooling paths and allowed to flow through the leading edge cavity and into a manifold assembly.

An advantage of this invention is the turbine vane regulates the flow of cooling fluids through the turbine vane and into the manifold assembly, while adequately cooling the turbine vane. The flow is regulated while minimizing cooling fluid pressure loss and minimizing the possibility of cooling fluid flow separation in the leading edge channel.

Another advantage of this invention is the turbine vane minimizes the possibility of cooling fluid overflow to the manifold assembly and underflow to the trailing edge of the turbine vane.

Yet another advantage of this invention is the cooling capacity of the turbine vane negates the need for orifices in the exterior surface of the turbine vane for external film cooling.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
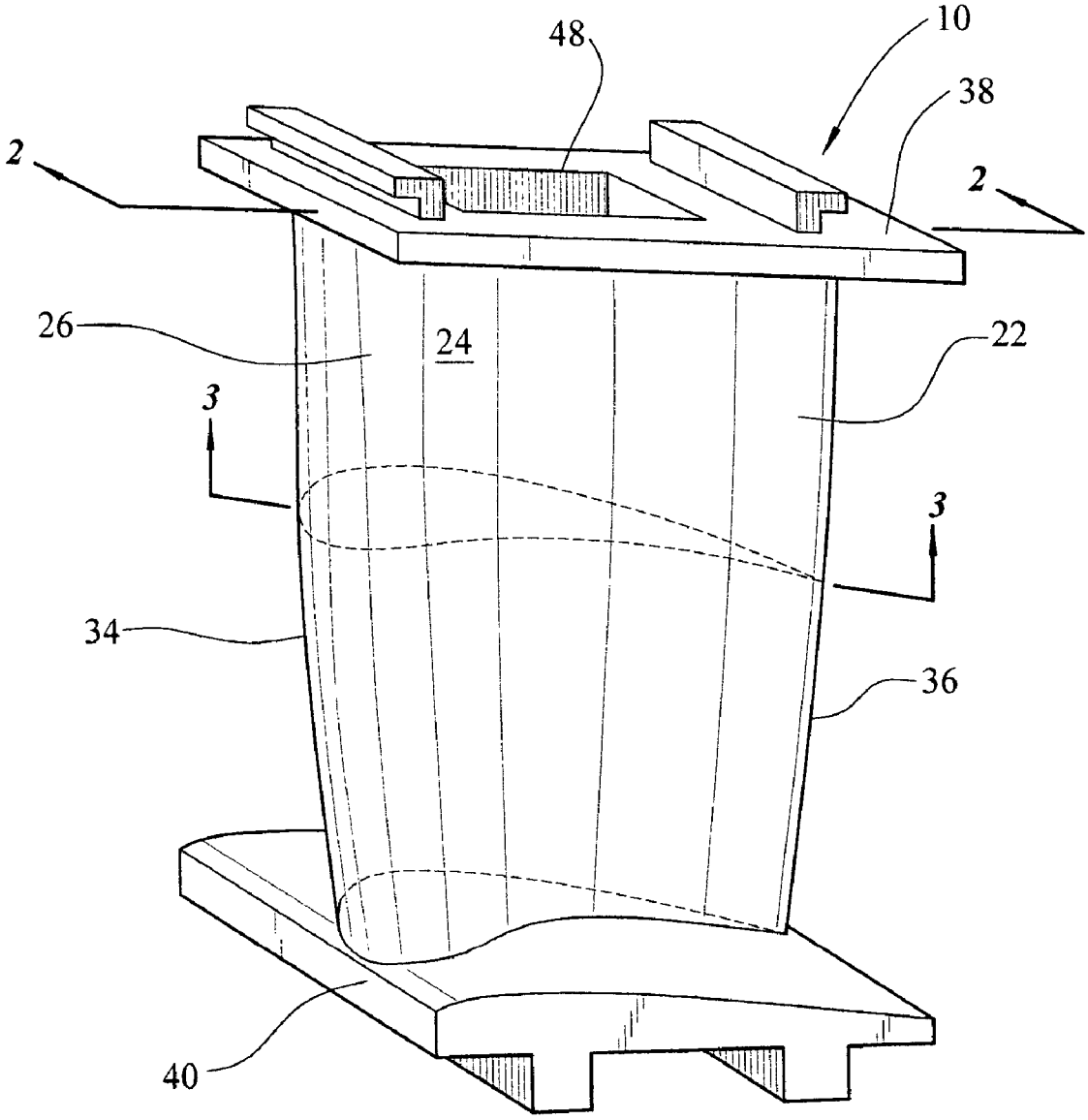
FIG. 1 is a perspective view of a turbine vane having features according to the instant invention.
Figure 2:
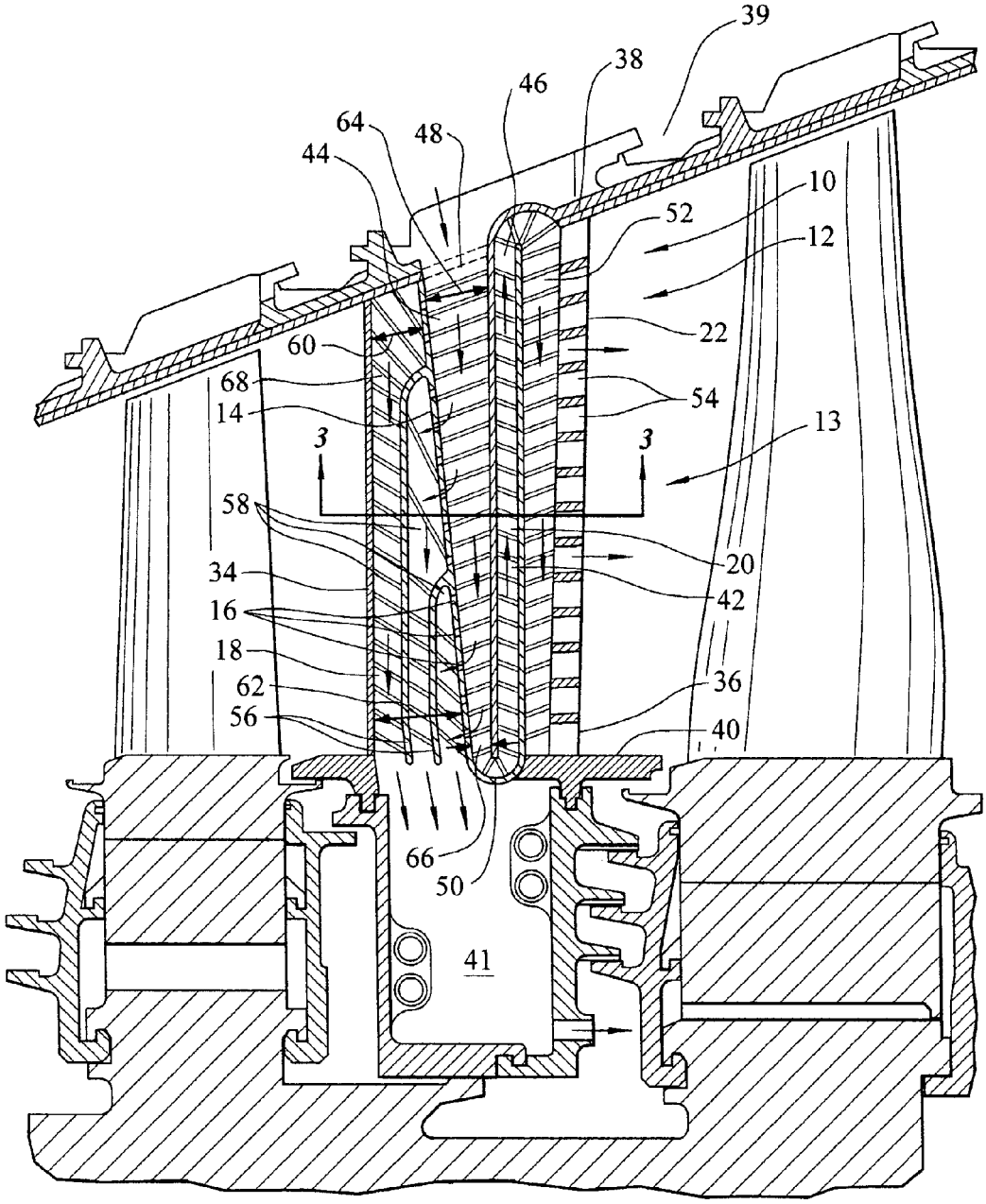
FIG. 2 is cross-sectional view of the turbine vane shown in FIG. 1 taken along line 2—2.
Figure 3:
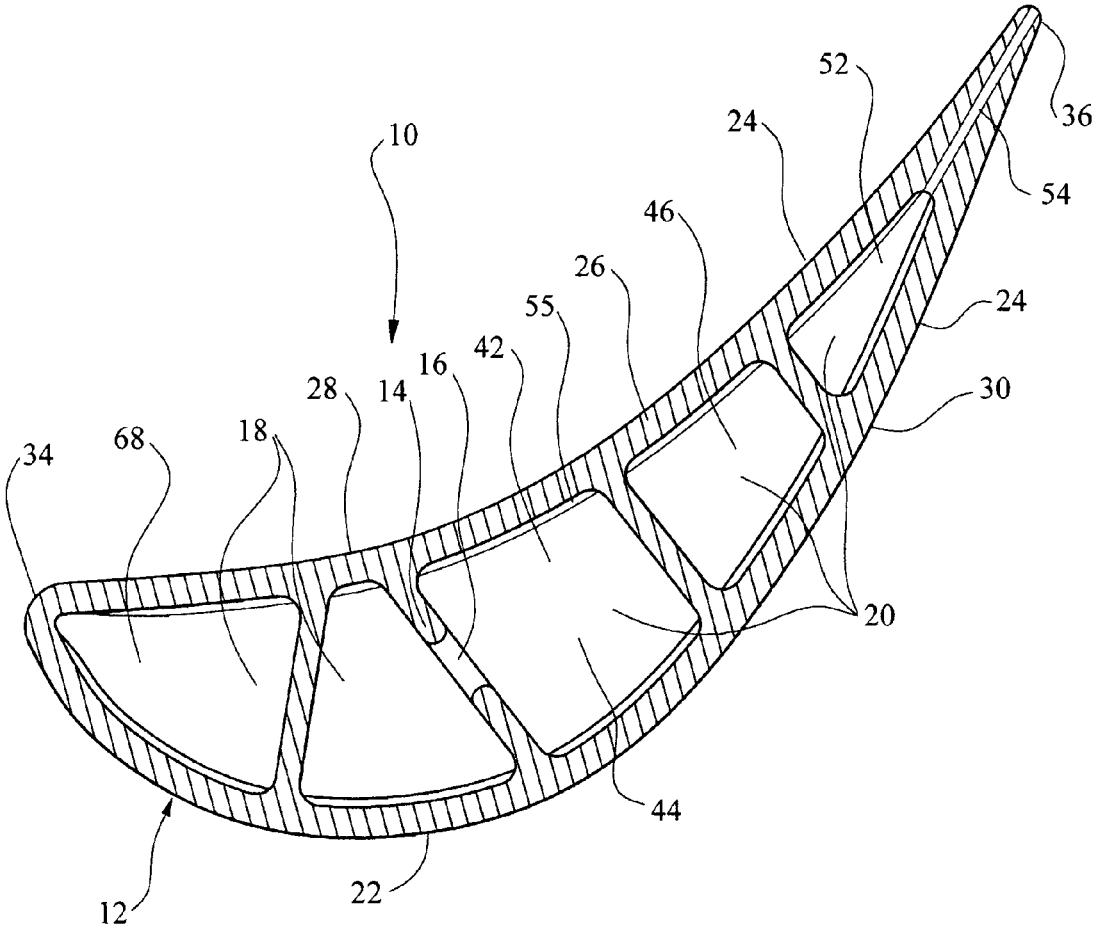
FIG. 3 is a cross-sectional view of the turbine vane shown in FIGS. 1 and 2 taken along line 3—3.

As own in FIGS. 2 and 3, the trailing edge cavity 20 may be formed from a serpentine cooling path 42 formed from at least a first inflow section 44 and a first outflow section 46. The first inflow section 44 may include one or more inlet orifices 48 for receiving a cooling fluid from a shroud assembly 39. In at least one embodiment, the first inflow section 44 may include only a single inlet orifice 48. A first turn 50 may couple the first inflow section 44 with the first outflow section 46 and provide a smooth pathway for cooling fluids to flow through. The first turn 50 may be formed from a continuous wall, as shown in FIG. 2. In at least one embodiment, the serpentine cooling path 42 may include a second inflow section 52, as shown in FIG. 2, forming a three-pass serpentine cooling path for directing cooling fluids towards the manifold assembly 41 to which the second end 40 of the vane 22 may be coupled. The turbine vane 10 is not limited to having a three-pass serpentine cooling path 42, but may have other numbers of passes. The trailing edge cavity 20 may also include one or more exhaust orifices 54 in the trailing edge 36 for exhausting cooling fluids from the turbine vane 10. The serpentine cooling path 42 may also include a plurality of trip strips 55 for mixing the cooling fluid as the cooling fluid flows through the serpentine cooling path 42.

The leading edge cavity 18 may be defined by the metering rib 14 and inside surfaces forming the leading edge 34 and the housing 26 of the airfoil 22. The leading edge cavity 18 may include a plurality of ribs 56 forming a plurality of leading edge cooling paths 58. In at least one embodiment, three leading edge cooling paths 58 may be formed. In another embodiment, other numbers of cooling paths 58 may be used. Each leading edge cooling path 58 may have one or more metering orifices 16 positioned relative to the ribs 56 to provide a pathway for cooling fluids to flow into each respective cooling path 58.

The metering rib 14 and metering orifice 16 may be used to regulate flow of cooling fluids through the leading edge cavity 18 and the trailing edge cavity 20. The cross-sectional area of the metering orifice 16 may be adjusted to regulate flow to the leading edge cavity 18. In addition, adjusting the cross-sectional area of the metering orifice 16 regulates cooling fluid pressure in the trailing edge cavity 20 and affects cooling of the housing 26 forming portions of the airfoil 22 proximate to the trailing edge 36. In at least one embodiment, the metering rib 14 may include a plurality of metering orifices 16. The metering orifices 16 may each have cross-sectional areas that are approximately equal. In other embodiments, the metering orifices 16 may have cross-sectional areas that are not equal. The metering orifices 16 may or may not be spaced equally from each other. The metering orifices 16 regulate the flow of cooling fluids and the pressure of cooling fluids in the cooling system in the manifold assembly 41, which may in some turbine engines be referred to as a TOBI system. The metering orifices 16 eliminate the potential of passing too much or too little cooling fluids to the manifold cooling system. Passing too much cooling fluids to the manifold assembly 41 can lead to overheating of the housing 26 proximate to the trailing edge 36 of the airfoil 22. Conversely, passing too little cooling fluids to the manifold cooling system can starve downstream components of a turbine engine, such as downstream turbine blades.

In at least one embodiment, the metering rib 14 may be positioned to form a convergent first inflow section 44 and a divergent leading edge cavity 18, as shown in FIG. 2. More specifically, the metering rib 14 may be positioned in a nonparallel position relative to the leading edge 34. In this position, divergent leading edge cavity 18 may include a first cross-sectional area 60 at a location proximate to the first end 38 of the airfoil 22 that is smaller than a second cross-sectional area 62 proximate to the second end 40 of the airfoil 22. The convergent first inflow section 44 of the serpentine cooling path 42 may include a first cross-sectional area 64 proximate to the first end 38 of the airfoil 22 that is greater than a second cross-sectional area 66 proximate to the second end 40 of the airfoil 22.

The convergent first inflow section 44 maintains constant cooling by regulating velocity of the cooling fluid. The divergent leading edge cavity 18 minimizes cooling fluid pressure loss by receiving cooling fluids through the metering orifices 16 into the leading edge cooling paths 58. The leading edge cooling paths 58 subdivide the leading edge cavity 18 into multiple radial flow channels and minimize the possibility of cooling flow separation in the main leading edge channel 68. The leading edge cooling paths 58 may be configured to have different sizes for tailoring the airflow through each individual leading edge cooling path 58 to accommodate different external heat loads found in different turbine engines.

During operation, a cooling fluid flows into the inlet orifice 48 in the serpentine cooling path 42 and into the first inflow section 44. At least a portion of the cooling fluid flows through the serpentine cooling path 42, removes heat from the housing 26 and other components of the serpentine cooling path 42, and is discharged through the exhaust orifices 54. The other portion of the cooling fluid flows through the metering orifices 16 and into the leading edge cavity 18. The cooling fluid passes through the leading edge cooling paths 58 and removes heat from the housing 26, metering rib 14, ribs 56, and other components forming the turbine vane 10.

In at least one embodiment, a small portion of the cooling fluid entering the inlet orifice 48 flows through the serpentine cooling path 42 and is discharged through the exhaust orifices 54. The remainder of the air is bled from the first inflow section 44 through the metering orifices 16 into the plurality of leading edge cooling paths 58 at a selected pressure and flow rate. The cooling fluid flows through the leading edge cavity 18 and is discharged into a manifold assembly 41 to provide cooling for downstream components. This configuration prevents the potential of overflow of the manifold cooling system, and thus, minimizes starvation of the trailing edge cavity 20 and serpentine cooling path 42 and minimizes overheating of the airfoil 26.

The foregoing is provided for purposes of illustrating, explaining, and describing embodiments of this invention. Modifications and adaptations to these embodiments will be apparent to those skilled in the art and may be made without departing from the scope or spirit of this invention.

What is claimed is:

1. A turbine vane, comprising:

a generally elongated hollow airfoil having a leading edge, a trailing edge, a pressure side, a suction side, a first end adapted to be coupled to a shroud assembly, and a second end opposite the first end adapted to be coupled to a manifold assembly;

a serpentine cooling path formed from at least a first inflow section and a first outflow section, the first outflow section in communication with the first inflow section and extending from a first turn formed from a continuous wall generally toward the first end of the generally elongated hollow airfoil;

at least one inlet orifice in the first inflow section of the serpentine cooling path at the first end of a generally elongated hollow airfoil;

at least one exhaust orifice in the trailing edge of the generally elongated hollow airfoil and coupled to the serpentine cooling path for exhausting cooling fluids from the serpentine cooling path;

wherein the first inflow section of the serpentine cooling path forms a generally linear cooling fluid pathway between the at least one inlet orifice and the first turn of the serpentine cooling path;

at least one leading edge cooling path positioned proximate to the leading edge;

at least one metering rib defining a barrier between a portion of the first inflow section and the at least one leading edge cooling path, wherein the at least one metering rib includes at least one metering orifice creating a fluid pathway between the first inflow section and the at least one leading edge cooling path; and wherein the at least one metering orifice in the metering rib is sized to regulate flow of cooling fluids through the at least one leading edge cooling path and into the manifold assembly.

2. The turbine vane of claim 1, wherein the at least one leading edge cooling path comprises three leading edge cooling paths separated by ribs extending substantially parallel to the leading edge and wherein each of the three leading edge cooling paths includes at least one metering orifice in the metering rib for providing a pathway for gases to fib from the first inflow section to each of the three leading edge cooling paths.

3. The turbine vane of claim 2, wherein the metering orifices have substantially equal cross-sectional areas.

4. The turbine vane of claim 2, wherein at least some of the metering orifices have different cross-sectional areas.

5. The turbine vane of claim 1, wherein the at least one leading edge cool pat is a divergent cooling path such that a first cross-sectional area of the divergent cooling path at a first end of the at least one leading edge cooling path proximate to the first end of the generally elongated hollow airfoil is smaller than a second cross-sectional area of the at least one leading edge cooling path proximate to the second end of the generally elongated hollow airfoil.

6. The turbine vane of claim 1, wherein the first inflow section of the serpentine cooling path is a convergent cooling path having a first cross-sectional area at the first end of the generally elongated hollow airfoil that is greater than a second cross-sectional area at the second end of the generally elongated hollow airfoil.

7. The turbine vane of claim 1, wherein the serpentine cooling path further comprises a second inflow section positioned between the first outflow section and the trailing edge and in communication with the first outflow section.

8. The turbine vane of claim 1, wherein the serpentine cooling path further comprises a plurality of trip strips.

9. The turbine vane of claim 1, wherein the at least one metering orifice comprises a plurality of metering orifices in the metering rib.

10. The turbine vane of claim 9, wherein at least a portion of the plurality of metering orifices have different cross-sectional areas.

11. The turbine vane of claim 1, wherein the metering rib is adapted to control flow of a cooling fluid through the turbine vane so that a sufficient amount of cooling fluid is passed through the serpentine cooling path to cool portions of the trailing edge.

12. A turbine vane, comprising:

a generally elongated hollow airfoil having a leading edge, a trailing edge, a pressure side, a suction side, a first end adapted to be coupled to a shroud assembly, and a second end opposite the first end adapted to be coupled to a manifold assembly;

a serpentine cooling path and formed from at least a first inflow section, a first outflow section, and a second inflow section, the first outflow section in communication with the first inflow section and extending from a first turn formed from a continuous wall generally toward the first end of the generally elongated hollow airfoil, the second inflow section positioned between the first outflow section and the trailing edge and in communication with the first outflow section;

at least one inlet orifice in the first inflow section of the serpentine cooling path at the first end of the generally elongated hollow airfoil;

at least one exhaust orifice in the trailing edge of the generally elongated hollow airfoil and coupled to the serpentine cooling path for exhausting cooling fluids from the serpentine cooling path;

wherein the first inflow section of the serpentine cooling path forms a generally linear cooling fluid pathway between the at least one inlet orifice and the first turn of the serpentine cooling path;

at least one divergent leading edge cooling path positioned proximate to the leading edge;

at least one metering rib defining a barrier between a portion of the first inflow section and the at least one leading edge cooling path, wherein the at least one metering rib includes at east one metering orifice creating a fluid pathway between the first inflow section and the at least one leading edge cooling path;

wherein the at least one metering orifice in the metering rib is sized to regulate flow of cooling fluid through the at least one divergent leading edge cooling path and into the manifold assembly; and wherein the at least one divergent leading edge cooling path has a first cross-sectional area at the first end of the generally elongated hollow airfoil that is smaller than a second cross-sectional area at the second end of the generally elongated hollow airfoil.

13. The turbine vane of claim 12, wherein the at least one leading edge cooling path comprises three leading edge cooling paths separated by ribs extending substantially parallel to the leading edge and wherein each of the three leading edge cooling paths includes at least one metering orifice in the metering rib for providing a pathway for gases to fib from the first inflow section to each of the three leading edge cooling paths.

14. The turbine vane of claim 13, wherein the metering orifices have substantially equal cross-sectional areas.

15. The turbine vane of claim 13, wherein at least some of the metering orifices have different cross-sectional areas.

16. The turbine vane of claim 12, wherein the first inflow section of the serpentine cooling path is a convergent cooling path having a first cross-sectional area at the first en of the generally elongated hollow airfoil that is greater than a second cross-sectional area at the second end of the generally elongated hollow airfoil.

17. The turbine vane of claim 12, wherein the serpentine cooling path further comprises a plurality of trip strips.

18. The turbine vane of claim 12, wherein the at least one metering orifice comprises a plurality of metering orifices in the metering rib.

19. The turbine vane of claim 18, wherein at least a portion of the plurality of metering orifices are different cross-sectional areas.

20. The turbine vane of claim 12, wherein the at least one metering orifice is adapted to control flow of a cooling fluid through the turbine vane so that a sufficient amount of cooling fluid is passed through the serpentine cooling path to cool portions of the trailing edge.

* * * * *